US006101764A

United States Patent [19]

Guy-Paul

[11] Patent Number: 6,101,764

[45] Date of Patent: Aug. 15, 2000

[54] PIVOTING DOOR OF THE TYPE HAVING AT LEAST ONE LEAF OF WHICH TWO BARS ARE MOUNTED IN PARALLEL BY MEANS OF LINKS

[75] Inventor: Alix Guy-Paul, Brest, France

[73] Assignee: L'Industrielle DuPonant SA, Landerneau, France

[21] Appl. No.: 09/243,349

[22] Filed: Feb. 1, 1999

[51] Int. Cl.[7] ..... E05C 9/00

[52] U.S. Cl. ..... 49/395; 292/48; 292/196; 49/367

[58] Field of Search ..... 49/394, 395, 366, 49/367, 368; 292/48, 196

[56] References Cited

U.S. PATENT DOCUMENTS

| | | | |
|---|---|---|---|
| 2,460,961 | 2/1949 | Wilson | 292/48 |
| 2,493,882 | 1/1950 | Lambert | 292/48 |
| 5,086,587 | 2/1992 | Andrews | 292/395 |
| 5,333,920 | 8/1994 | de Rover | 292/48 |

FOREIGN PATENT DOCUMENTS

| | | | |
|---|---|---|---|
| 2301371 | 8/1974 | Germany | 292/48 |
| 757676 | 8/1980 | U.S.S.R. | 292/48 |

*Primary Examiner*—Jerry Redman
*Attorney, Agent, or Firm*—Laff, Whitesel & Saret, Ltd.; J. Warren Whitesel

[57] ABSTRACT

A pivoting watertight door has at least one panel with two parallel bars mounted thereon by means of links. At least one link forms a catch for locking the door in a closed position. The links are mounted so as to pivot on the door panel and also on the parallel bars where the bars are connected together at their ends, in pairs, and facing each other. Two connecting links are mounted so as to pivot on the one hand on the panel and on the other hand on two facing ends of the bars.

7 Claims, 7 Drawing Sheets

PIVOTING DOOR OF THE TYPE HAVING AT LEAST ONE LEAF OF WHICH TWO BARS ARE MOUNTED IN PARALLEL BY MEANS OF LINKS

The present invention concerns a pivoting door of the type having at least one panel hereinafter called "leaf" on which two bars are mounted in parallel by means of links. The invention applies notably to a metal door intended to be mounted on a ship or an infrastructure on land.

BACKGROUND

Metal ship doors are generally designed to be watertight in relation to the frames on which they are respectively mounted. For this reason, provision has been made for providing these doors with systems for locking in the closed position which are such that the said doors can remain closed even in the event of accidental overpressure, so as to prevent the entry of water or air into the corresponding rooms.

European patent document EP-B-552 505 presents a locking system which is supposed to reliably ensure the watertightness of a ship door. According to a preferential example embodiment which is described in this document in relation to FIG. 3, this locking system is notably characterised by a high number of catches (six in number in the example depicted) so as to effectively guarantee the aforementioned locking. These catches are designed to conic into abutment against walls internal to the frame on which die door is mounted, The system essentially comprises of two bars mounted vertically on a door leaf by means of the catches, which are respectively pivotally mounted on the leaf and articulated on each bar. These two bars are connected to each other and at their facing top and bottom ends by two horizontal arms, on which other catches are articulated. Each arm is connected by its ends to the corresponding ends of the bars, by means of two links articulated on the bars. Each link, this is pivotally mounted on the leaf.

A control handle designed to move the bars via a link to which it is connected and consequently to cause the catches to pivot about their respective pivots so as to release them from the frame. The handle is mounted so as to be connected with the bar which is furthest away from the leaf hinges.

A major drawback of such a locking system lies in the complexity of its manufacturing process.

SUMMARY OF THE INVENTION

The aim of the present invention is to remedy this drawback, by a pivoting door of the type with at least one leaf on which two bars are mounted parallel by means of links. At least one link forms a catch for locking the door in the closed position. The links are pivotally mounted on the leaves and on the bars, which offers guarantees of security in the locking position, whilst being manocuvrable without requiring a high force.

To this end, a door according to the invention is characterised in that the bars are connected together at their ends in pairs facing each other by two connecting links, each one of which is pivotally mounted on the one hand on the leaf and on the other hand on two facing ends of the bars.

According to another characteristic of the invention, at least one of the connecting links is designed to constitute a means of locking the door in the closed position.

According to another characteristic of the invention, each bar has two end parts angled on the same side of the said bar and designed to be mounted by pivots on the connecting links. The said pivots are mounted so as to be diametrically opposed with respect to the pivots for fixing the connecting links to the leaf or leaves.

According to one embodiment of the invention at least one of the bars is also designed to constitute, by means of one of its ends) a means of locking the door in the closed position.

According to another characteristic of the invention, a control handle pivotally mounted on the one hand on the pivot for fixing one of the catches to the leaf, which is articulated on the bar adjacent to the pivoting edge of the said leaf, and on the other hand on the pivot for articulating the catch on the bar. The control handle is designed to control the raising of a control link, on which it is articulated between the pivots, so as to move the bar in the direction of pivoting of the handle and the other bar in the opposite direction, by means of the connecting means, and thus to cause the catches to pivot with respect to the leaf.

According to a variant embodiment of the invention, the said door has two leaves, one of which is provided with at least one link forming a catch designed to come into abutment against an element on the other leaf, in the position for locking of the leaves.

BRIEF DESCRIPTION OF THE DRAWING

The characteristics of the invention mentioned above, as well as others, will emerge more clearly from a reading of the following description of an embodiment, the description being given in relation to the accompanying drawings, in which.

DETAILED DESCRIPTION OF THE INVENTION

Figure 1:
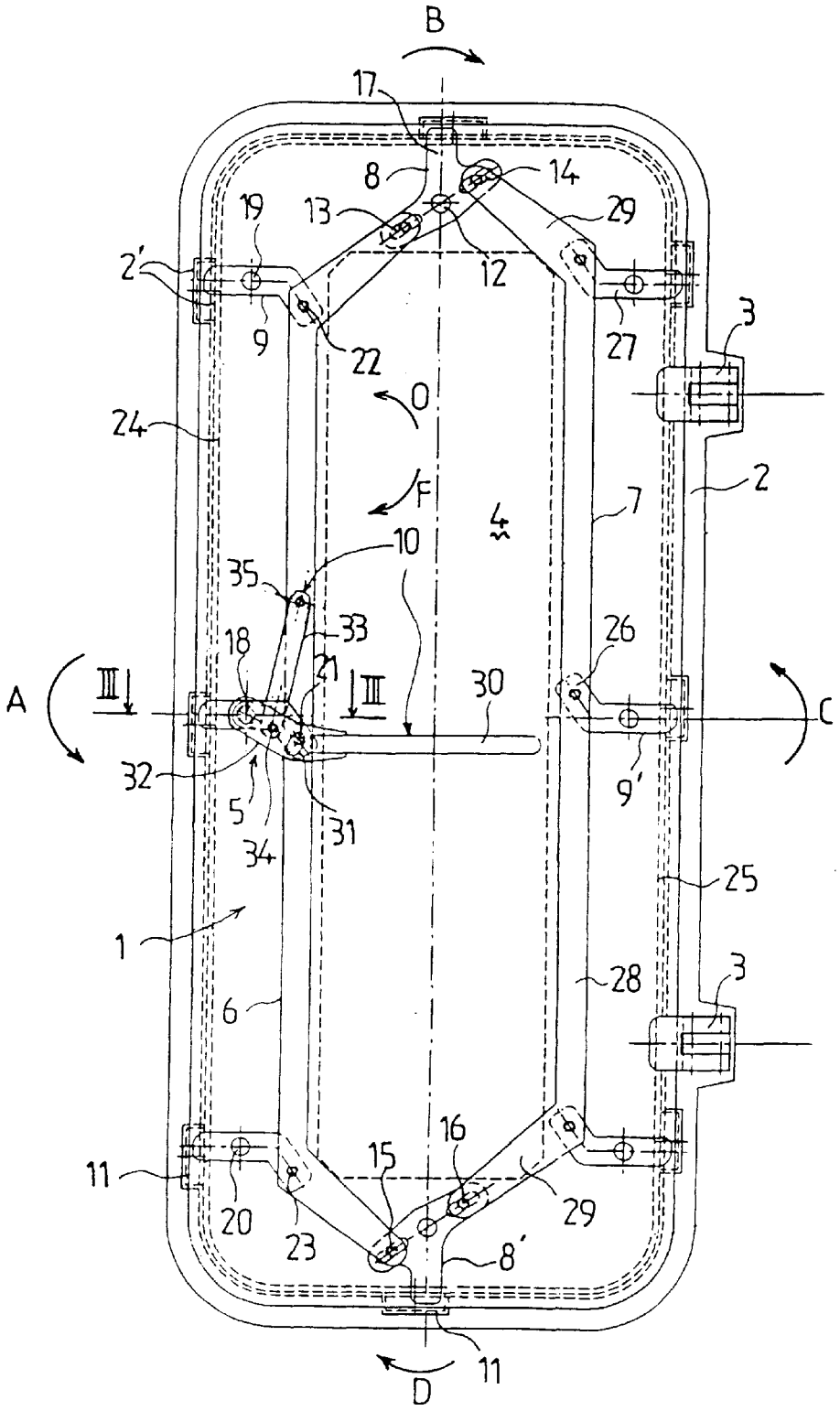
FIG. 1 is a front view of a door according to a first embodiment of the invention which is locked in the closed position.

As depicted in FIG. 1, the door 1 according to a first embodiment of the invention is intended to be mounted on a frame 2 by means of hinges 3. The door 1 consists essentially of a leaf 4 and locking means 5 mounted on the leaf 4 and designed to lock the door 1 in the locked position in the frame 2.

The locking means 5 include two identical vertical movable bars 6 and 7 which are mounted on the leaf 4 by means of first and second catches 8, 8' and 9, 9'. For convenience of expression, catches 8,8' will sometimes be called "toggle" catches hereinafter. As can be seen in the detail view in FIG. 2, the locking means 5 are contained in a plane parallel to the plane of the leaf 4.

The locking means 5 also include members 10 designed to control the passage of the catches 8, 8' and 9, 9' from a locked position (depicted in FIG. 1) to an unlocked position (depicted in FIG. 4), or vice versa. These members 10 are connected to the bar 6 which is furthest away from the hinges 3.

The catches 8, 8' and 9, 9' are mounted so as to pivot with respect to the leaf 4, and are each designed to come into abutment against a sloping part 2' of a recess keeper 11 internal to the said frame 2 (the slope of this part 2' is formed in the vertical direction of the door 1).

Each first toggle catch 8, 8', or connecting catch, is mounted so as to pivot with respect to the leaf 4 by means of a pivot 12 fixed to the leaf 4. The connecting toggle catches 8 and 8' are two in number, and are respectively mounted close to the top edge and bottom edge of the leaf 4, in the longitudinal axis of symmetry of the latter. Each connecting catch 8, 8' has, at two of its ends, two oblong holes 13 and 14 of linear shape which are situated at equal distances from the fixed pivot 12 and which are diametrically opposed in the direction of their length with respect to the pivot 12.

Each bar 6, 7 has, at each of its ends, a pivot 15, 16 which is movable with respect to the leaf 4 and which is mounted in one of the oblong holes 13, 14.

The two connecting catches 8 and 8' are thus designed to connect together the two bars 6 and 7.

Each connecting toggle catch 8, 8' has a third end 17 which is designed to engage in the corresponding recess 11. As can be seen in FIG. 1, the ends 13, 14 and 17 of each toggle catch 8, 8' confer on it substantially the shape of a λ whose top is formed by the end 13.

Each second catch 9, 9' is mounted so as to pivot with respect to the leaf 4 by means of a pivot 18, 19, 20 fixed to the leaf 4. Bach bar 6 (or respectively 7) is articulated on the same number of second catches 9 (or respectively 9'), by means of pivots 21, 22 and 23 which are movable with respect to the leaf 4. As can be seen in FIG. 1, each fixed pivot 18, 19, 20 is mounted between the longitudinal edge 24, 25 of the leaf 4 and the bar 6, 7 which is mounted adjacent to the said edge 24, 25.

Each second catch 9, 9' has a unique shape, and consists for example, on the one hand, of a first linear part 26 intended to have one of the movable pivots 21, 22 and 23 pass through it and, on the other hand, of a second part 27, also linear, intended to have one of the fixed pivots 18, 19 and 20 pass through it and forming an obtuse angle with the previous one.

In this example embodiment, the major part 28 of each bar 6, 7, or middle part, has a linear shape and is designed to be mounted vertically, Each bar 6, 7 also has two identical linear end parts 29 which diverge with respect to each other on the same side of the said middle part 28 and which end in the said movable pivots 15 and 16.

In the example of FIG. 1, each bar 6, 7 is articulated on three second catches 9, 9', by means of the movable pivots 21, 22 and 23 which are respectively mounted at the middle and at the two ends of the middle part 28. As for the fixed pivots 18, 19 and 20 mounted opposite the same bar 6, 7, these are aligned in a vertical direction.

As can be seen in FIG. 1, the movable pivots 21, 22 and 23 and the fixed pivots 18, 19 and 20 relating to the same bar 6, 7 form the vertices of a deformable parallelogram. One of the large sides of this parallelogram joins the fixed pivots 18, 19 and 20 and is itself fixed with respect to the leaf 4.

Figure 2:
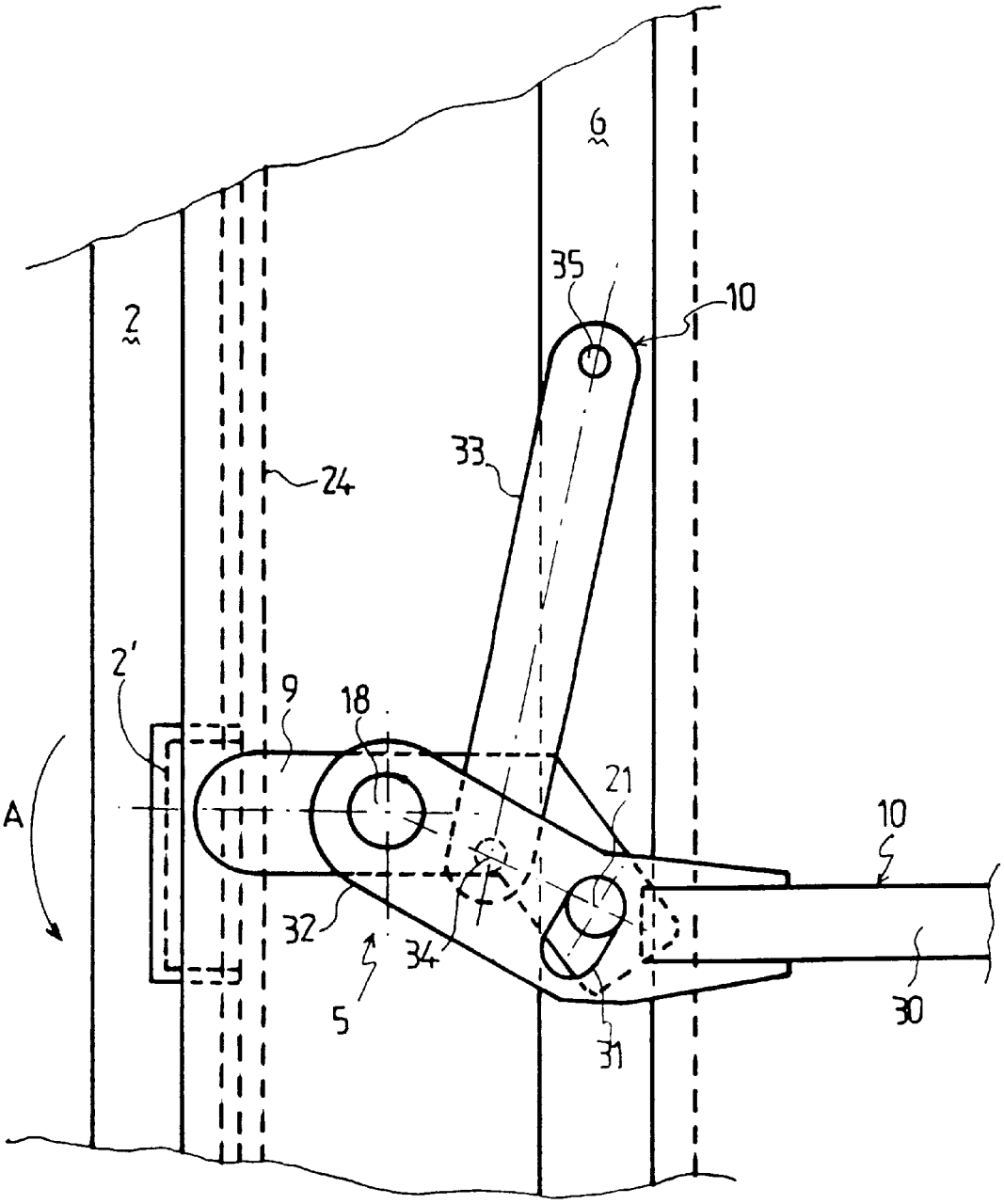
FIG. 2 is a detail front view of the members for controlling the door in the open or closed position.
Figure 3:
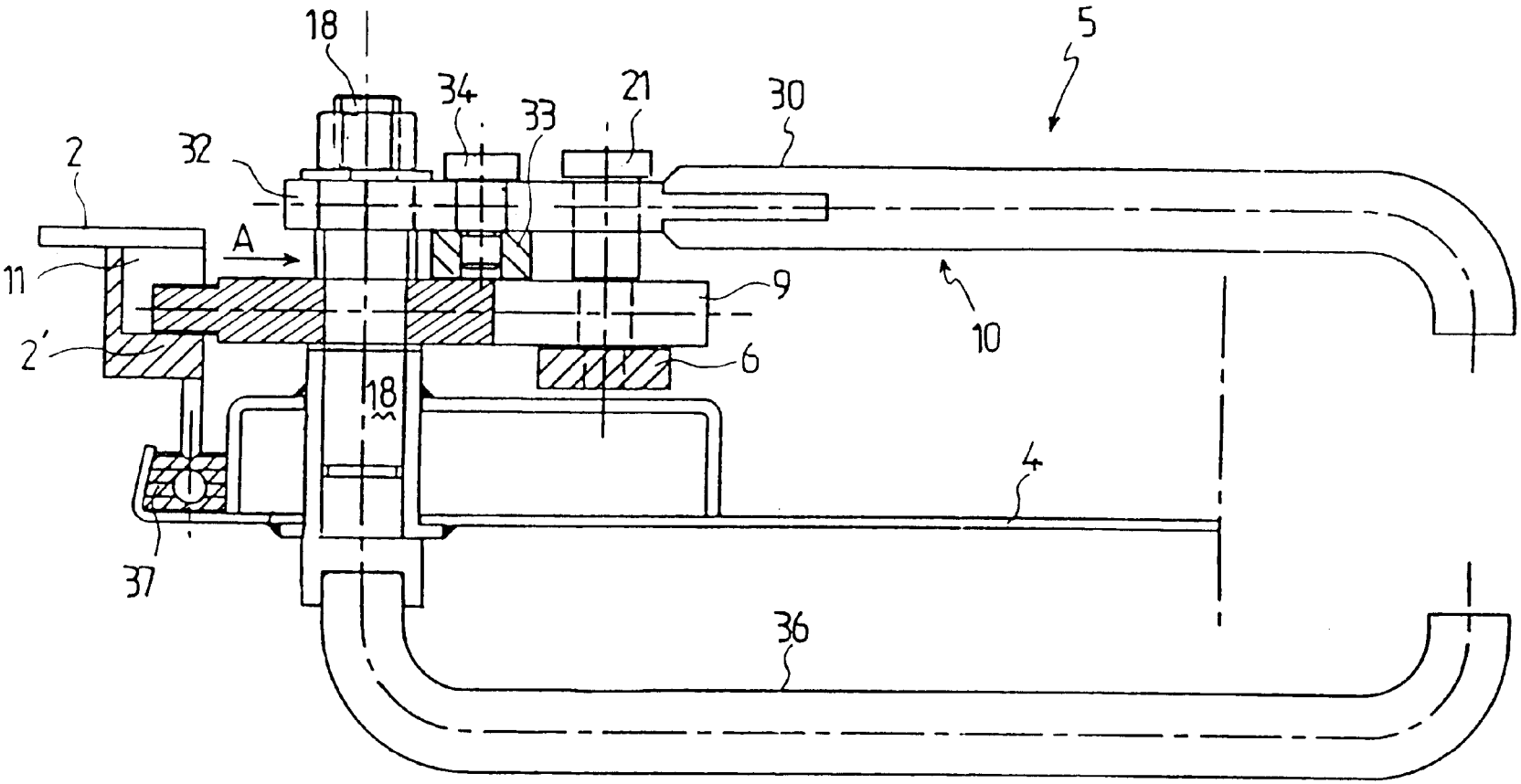
FIG. 3 is a view in partial section of the door along the plane III—III in FIG. 1.

The control members 10 of the bars 6 and 7 are depicted in detail in FIGS. 2 and 3.

They include a handle 30 in the form of a sleeve which is mounted so as to pivot with respect to the loaf 4 by means of the fixed pivot 18 which is adjacent to the bar 6. The handle 30 is also mounted on the movable pivot 21 passing through the mid-point of the bar 6 by means of an oblong hole 31 (see FIG. 2) with which the handle 30 is provided.

As can be seen in FIG. 2, the oblong hole 31 has the shape of an arc of a circle which is centred on the fixed pivot 18 forming a rotation axis of the handle 30. The latter, the bar 6 and the catch 9 which is median with respect to it arc thus all mounted on the movable pivot 21. In the locked position of the door 1 illustrated in FIG. 2, the top end of the oblong hole 31 is in contact with the pivot 21.

With reference to FIG. 2, the handle 30 has an angled part 32 which is designed to have the pivots 18 and 21 pass through it.

In addition, the control members 10 include a link 33 which is mounted so as to pivot, at one of its ends, on the handle 30 by means of a pivot 34 mounted on the handle 30 between the middle pivot 18 and 21. The link 33 is connected at its other end to the bar 6 by means of a pivot 35 on the bar 6. The pivot 35 is mounted above the middle pivot 21 and, in this embodiment, the distance which separates it therefrom is substantially equal to one third of the distance provided between the said middle pivot 21 and the top pivot 22.

As depicted in FIG. 3, the means 5 provided for locking the door 1 in the locked position, as just described, are mounted on the leaf 4 on the same side thereof. As from the handle 30 which is furthest away from the plane containing the leaf 4 and as far as the latter, there are successively mounted, on the handle 30, the link 33 via the pivot 44, the middle catch 9 via the pivots 18 and 21, and the bar 6 via the movable pivot 21.

The handle 30 is extended on the other side of the leaf 4 by another handle 36, which is mounted on the fixed pivot 18 by means of a right-angled bend provided.

FIG. 3 depicts a sealing joint 37 which is mounted at the periphery of a face of the leaf 4 and which is designed to come against the frame 2 of the door 1, when the latter is controlled in the locked position illustrated by FIG. 3.

It will be noted that the inclination of the aforementioned sloping parts 2' which are respectively designed to receive in abutment the catches 8, 8', 9 and 9' is designed to allow the clamping of the door 1 by crushing and compressing an elastomer joint 37, when the door 1 is locked in the closed position.

It will also be noted that the clamping of the door 1 in the closed position is made possible by a slight translation of the door 1 in its hinges 3, in a direction perpendicular to the plane of the frame 2 and in the direction of the compression of the said joint 37.

The door 1 according to this first embodiment of the invention functions as follows.

Figure 4:
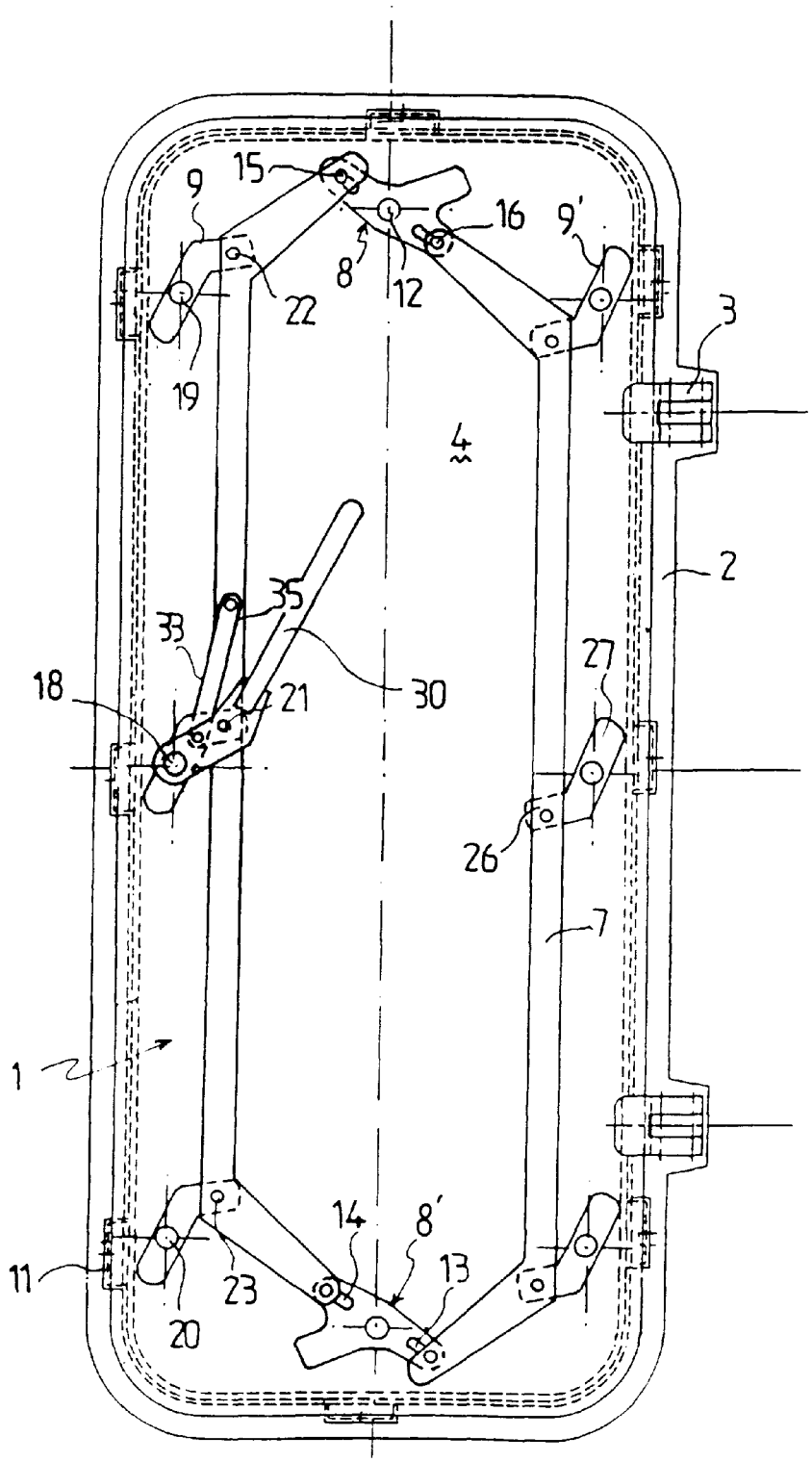
FIG. 4 is a schematic front view of the door of FIG. 1 which is unlocked in the closed position.

When it is wished to cause it to pass from the locked position in FIG. 1 to the unlocked position depicted in FIG. 4, the handle 30 (or the other handle 36, 20 depending on which side or the other of the door 1 is in question) is caused to pivot upwards about the fixed pivot 18, so that the bottom end of the oblong hole 31 of the handle 30 comes into contact with the movable pivot 21, which is fixedly mounted on the handle.

The effect of this pivoting of the handle 30 above the pivot 18 is to move upwards the bottom pivot 34 and consequently the top pivot 35 of the link 33. As a result there is a raising of the bar 6 in a vertical translation movement, as depicted in FIG. 4.

The raising of the bar 6 simultaneously causes the pivoting of the three catches 9 in the direction of the arrow A (FIGS. 1 and 2), about their respective axes consisting of the three pivots 18, 19 and 20. The result of this triple pivoting is to release, with respect to the bar 6, the second part 27 of each catch 9 of the sloping part 2' of the frame 2 against which it abutted, inside the corresponding keeper recess 11. This release of the catches 9 adjacent to the bar 6 is depicted in FIG. 4.

The aforementioned raising of the bar 6 also has the effect of simultaneously raising the end of the top connecting toggle catch 8 to which it is connected, by the upward force exerted by the pivot 15 of the bar 6 on the top edge of the oblong hole 13 constituting the end.

This raising of the end 13 of the connecting toggle catch 8 is accompanied by a proportional lowering of the opposite end 14 of the said catch B. This lowering results in releasing the third end 16 of the toggle catch 8 from the keeper recess 11. The pivoting movement of the catch 8 about the fixed pivot 12 is illustrated by the arrow B in FIG. 1.

It can be seen in FIGS. 1 and 4 that the pivot 15 which is fixed to the bar 6 passes from a first position (FIG. 1) where it is situated between the two ends of the oblong hole 18, to a second position in which it comes to abut against the end of the hole 13 which is furthest away from the fixed pivot 12 (FIG. 4). In the same way, the pivot 16 which is fixed to the bar 7 passes from a first intermediate position between the ends of the oblong hole 18 to a second position in which it comes to abut against the end of the hole 14 which is furthest away from the pivot 12.

This pivoting of the toggle catch 8 causes a lowering of the bar 7 in a substantially vertical direction by a height identical to the height of raising of the bar 6. The result is a pivoting of the three catches 9' to which the bar is connected in the direction of the arrow C (FIG. 1), so that the second part. 27 of each catch 9' is released from the recess 11 designed to receive it.

The aforementioned raising of the bar 6 and the concomitant lowering of the bar 7 has the effect of causing the bottom connecting catch 8' to pivot in the direction of the arrow D (FIG. 1), by means of the upward and downward forces respectively exerted by the pivots 15 and 16 on the oblong holes 13 and 14 in the catch 8'. This pivoting results in releasing the third end 17 of the catch 8' from the corresponding keeper recess 11.

As with the top catch 8, it can be seen in FIG. 4 that the bottom pivots 15 and 16 occupy extreme positions in the corresponding oblong holes 13 and 14 in the bottom catch 8'.

Consequently, the upward actuation of the handle 30 results in all the catches 8, 8' and 9, 9' of the door 1 occupying a position which is such that the door 1 can be opened. To do this, a thrust force is exerted on the handle 30 (or a traction force on the other handle 36) whilst keeping the latter in the raised position, It will be noted that, during the aforementioned operation of unlocking the door 1, the release of the catches 8, 8', 9 and 9' from the sloping parts 2' results in the sealing joint 37 ceasing to be compressed between the door 1 and the frame 2. The result is a slight translation movement of the door 1 in its hinges in the direction of an expansion of the joint 37.

When it is wished to cause the door 1 to pass from the unlocked position of FIG. 4 to the locked position of FIG. 1, the handle 30 (or handle 36) is caused to pivot downwards with respect to the pivot 18, as indicated in FIG. 1 by the arrow F, so that the top end of the oblong bole 31 comes into contact with the pivot 21. This lowering of the handle 30 has the effect of lowering the top pivot 35 of the link 33 and consequently the bar 6. Contrary to that which has just been described concerning the actuation of the door 1 in the unlocked position, this lowering of the bar 6 is accompanied by a simultaneous raising of the bar 7 in the same proportion. The result is a pivoting of the toggle catches 8, 8' and 9, 9' in directions which are the reverse of those indicated by the arrows A, B, C and D.

In this first embodiment of tie invention, it will be noted that each longitudinal bar 6 or 7 has two end parts 29 which are angled with respect to the remainder of the bar 6 or 7 in the direction of the other bar 7 or 6, so that two adjacent end parts 29 belonging respectively to the bars 6 and 7 have their end pivots 15 and 16 mounted in the immediate vicinity of each other, This makes it possible to use a single connecting means of the link type such as the aforementioned toggle catch 8, 8', which means is provided for connecting together the facing pivots 15 and 16.

According to an advantageous characteristic of the invention, the connecting means 8, 8' is also designed to engage against the sloping part 2' of the frame 2, like each catch 9, 9'.

It will be noted that the bars 6 and 7 can easily be moved with respect to each other by actuating the handle 30 (or 36), because of the relatively small moment of inertia which characterises each connecting catch 8, 8' and which facilitates the pivoting thereof. Consequently the door 1 has the advantage of being able to be controlled in the locked and unlocked positions by means of a force exerted on the handle 30 (and 36) which is of reduced intensity.

For the following description of a second embodiment of the invention, numerical references increased by 200 are used for designating elements having an identical or similar structure to that of the previously described elements.

Figure 5:
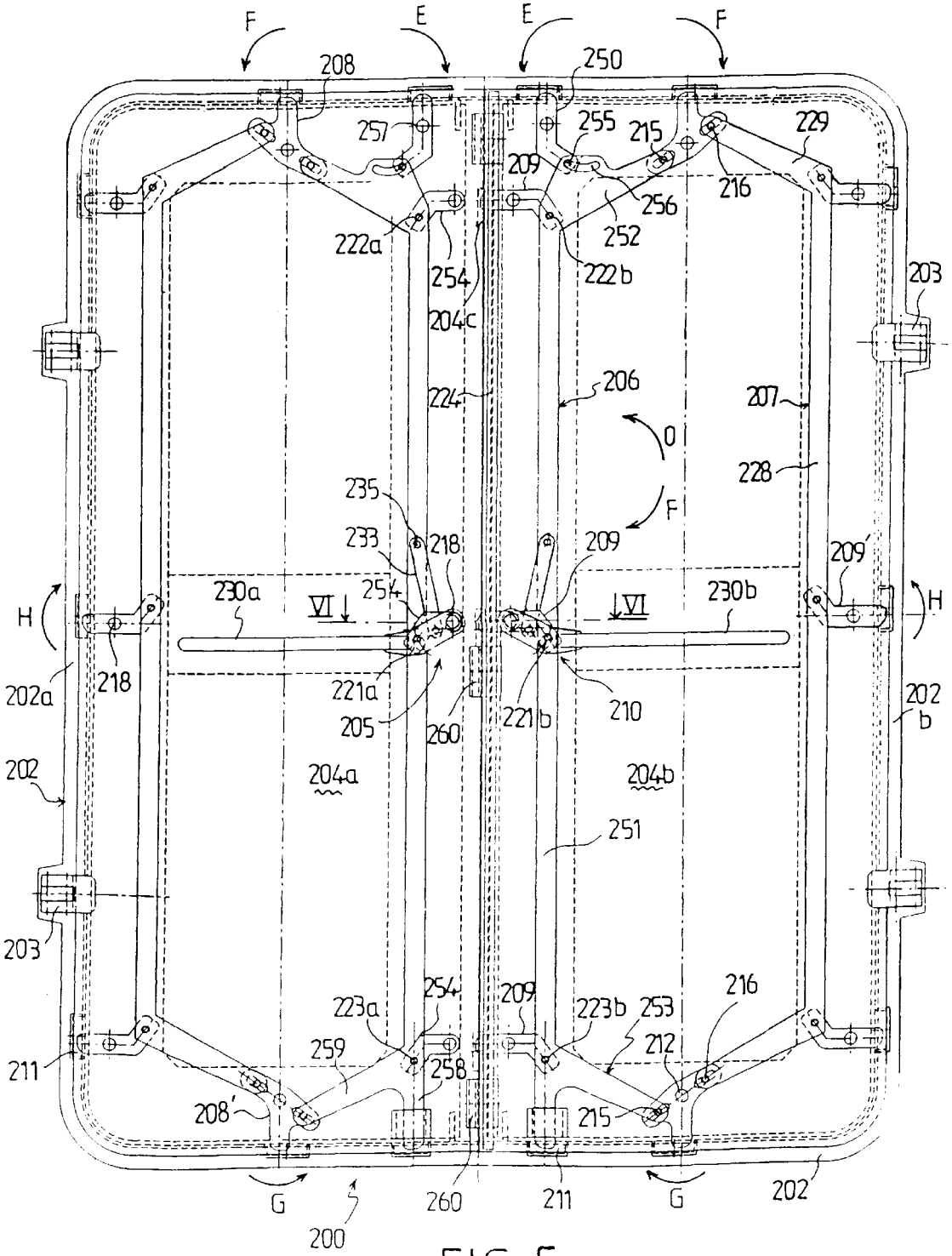
FIG. 5 is a front view of a door according to a second embodiment in the locked position.

A door 200 according to a second embodiment of the invention is depicted in FIG. 5. It has two leaves 204*a* and 204*b* which are respectively mounted so as to pivot on the two jambs 202*a* and 202*b* of a frame 202 by means of hinges 203. The door 200 also has means 205 mounted on each frame 204*a*, 204*b* and designed to lock the door 200 in the locked position in the frame 202.

In the example of this third embodiment which is depicted in FIG. 5, the locking means 205 with which each leaf 204*a*, 204*b* is provided are contained in a plane parallel to that of the leaf 204*a*, 204*b*, and include two bars 206 and 207 with different shapes. The bars 206 and 207 on the same leaf 204*a*, 204*b* are mounted on the leaf 204*a*, 204*b* parallel to the axis of the hinges 203 thereof, by means of first and second catches 208, 208', 209, 209' of the aforementioned type and also a third catch 250 which is different from the previous ones.

Figure 6:
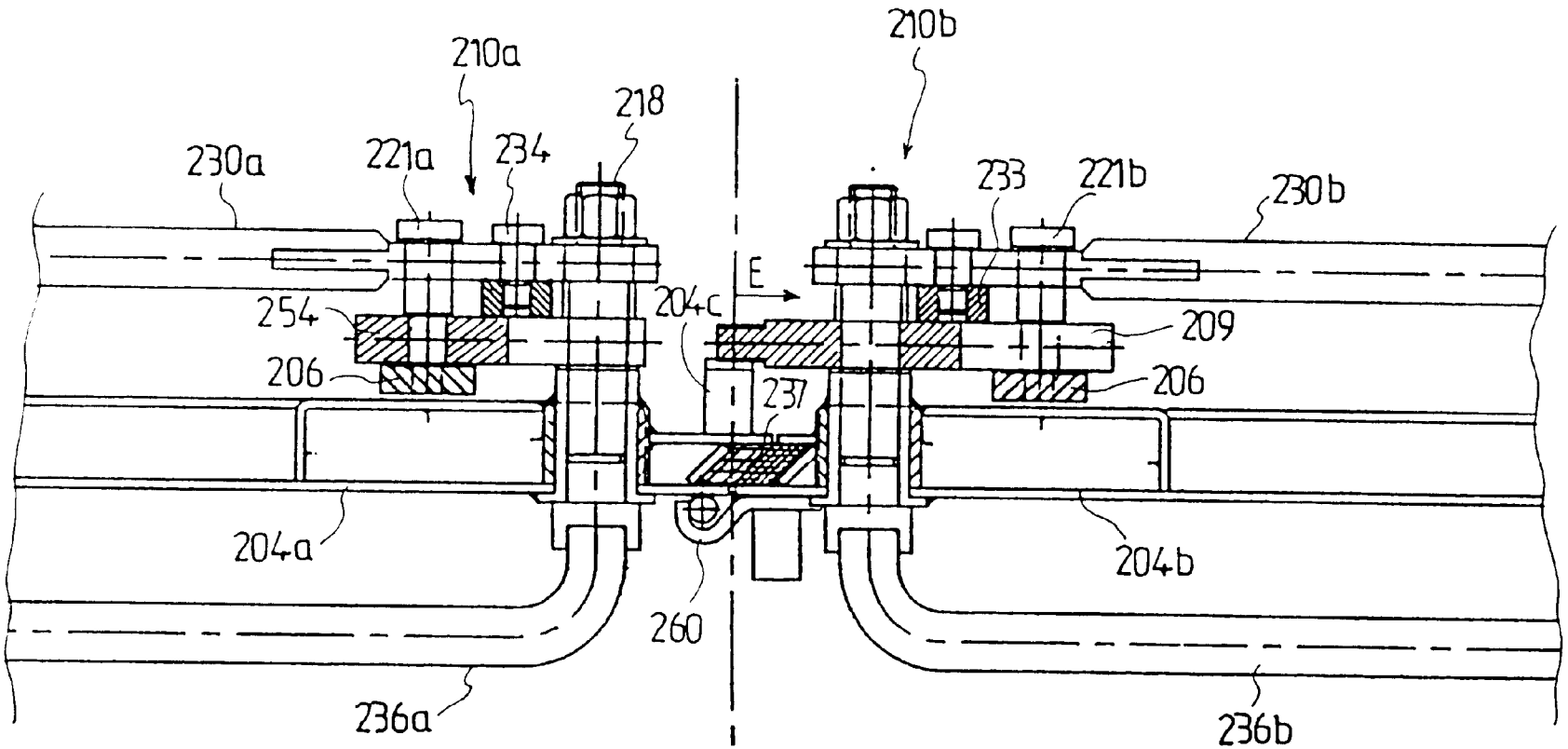
FIG. 6 is a partial view in section along the plane VI—VI in FIG. 5 of a door according to the second embodiment.
Figure 7:
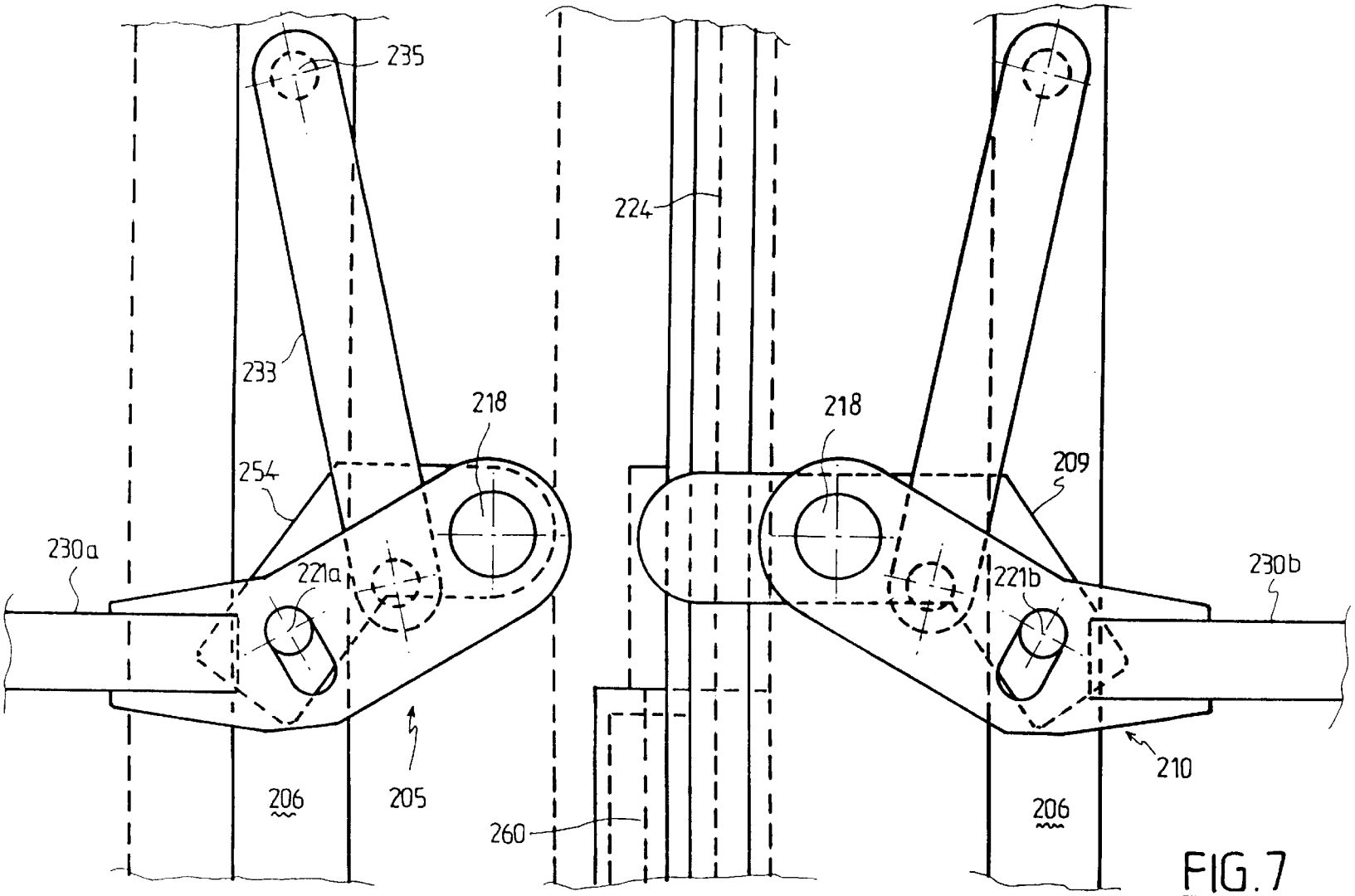
FIG. 7 is a detail front view of the members provided for controlling the door according to a second embodiment in the open and closed position.

As for the members 210 designed to control the passage of the catches 208, 208', 209, 209', 250 from a locked position to an unlocked position, or vice versa, these are depicted in detail in FIGS. 6 and 7.

These members 210 are mounted on the bar 206 of each leaf 204*a*, 204*b* which is furthest away from the said hinges 203. As can be seen in FIGS. 6 and 7, the handle 230*a*, 230*b* and the link 233 of the said control members 210 which are mounted on each leaf 204*a*, 204*b* have an identical structure to that of the same constituents of the control members 10, according to the first embodiment. They will therefore not be the subject of any special description.

The bar 207 of a leaf 204*a*, 204*b* which is adjacent to the hinges 203 thereof has a structure similar to that of the bars 6 and 7 of the first embodiment. The middle part 228 of this bar 207 is connected to several second catches 209' (also three in number in the example in FIG. 5). The top and bottom parts 229 which each extend the middle part 228 on the same side of the latter are respectively connected to the first catches 208 and 208' by pivots 216.

For each leaf 209*a*, 209*b*, the bar 206 which is furthest away from the hinges 203 has a middle part 251 similar to the middle part 228. The bar 206 also has a top part 252 and a bottom part 253 which respectively extend the middle part 251 upwards and downwards, on the same side of the latter.

Concerning one of the leaves 204*a*, the middle part 251 of the bar 206 is connected to several links 254 (three in number in this example, by a middle pivot 221*a* and two end pivots 222*a* and 223*a*, respectively. Each link 254 is designed to guide the bar 206 in its movement, when the control members 210 are actuated.

Concerning the other leaf 204*b*, the middle part 251 of the bar 206 is connected to several second catches 209 (three in number in this example) by pivots 221*b*, 222*b* and 223*b*, which are mounted opposite the pivots 221*a*, 222*a* and 223*a* of the leaf 204*a*. As can be seen in FIG. 6, each second catch 209 is designed to come into abutment against a sloping part 204C fixed to the other leaf 204*a*.

As with the first embodiment, it should be noted that the inclination of this sloping part 204*c* enables the door 200 to be clamped in the closed position, by crushing the elastomer scaling joint 237 which surrounds the said leaf 204*b*.

The top part 252 of the bar 206 is designed on the one hand to be connected to the third catch 250 by a pivot 255 and on the other hand to be connected to the first top catch 208 by a pivot 215. The pivots 215 and 255 define a triangle with the top pivot 222. The top vertex of this triangle is formed by the pivot 255, which is for example designed to move in a curved oblong hole 256 in the part 252. As can be seen in FIG. 5, the curvature of the oblong hole 256 is directed towards a fixed pivot 257 with respect to which the catch 250 is designed to pivot.

The bottom part 253 of the bar 206 consists of two arms 258 and 259 which extend the middle part 251 downwards, respectively in the same direction and at an acute angle with respect thereto, so that the arm 259 moves away from the middle part 251 on the same side as the said top part 253. The arm 258 is designed to cooperate, in the manner of a catch, with a recess 211 in the frame 202, whilst the arm 259 is designed to be connected to the first bottom catch 208' by a pivot 215.

FIGS. 5 and 6 also depict means 260 designed to ensure the mutual overlap of the non-hinged edges 224 of the leaves 204*a* and 204*b*, so as to ensure that the door 200 is scaled In the closed position.

A door 200 according to this third embodiment of the invention functions as follows.

When it is wished to unlock the door 200, the handle 230*a* controlling the leaf 204*a* is first of all raised, and then the handle 203*b* of the leaf 204*b* (see arrow O), so as to move the top pivot 235 of each link 233 upwards. As with the first embodiment, the result is a raising of each bar 6, which is accompanied by a lowering of each bar 7 by means of each first catch 208, 208'.

This movement in reverse directions of the bars 6 and 7 in a vertical direction has the effect of pivoting the links 254 of the leaf 204*a*, the second catches 209 and the third catch 250 of the leaf 204*b* in the direction indicated by the arrows E. This movement also has the effect of pivoting the first catches 208, 208' of each leaf 204*a*, 204*b* in the direction indicated by the arrows F and G, respectively, and the second catches 209' of the leaves 204*a* and 204*b* in the direction of the arrows H.

During these movements of the bars 6 and 7 and catches 208, 208', 209, 209', 250, the arm 258 of the bottom part 253 relating to each bar 6 progressively disengages from the recess 211 designed to receive its end, because of the raising of the bar 6. In addition, each second catch 209 of the leaf 204*b* disengages from the shoulder 204*c* designed to receive it, because of its pivoting.

As for each third catch 250, it will be noted that the pivot 255 to which it is attached moves inside the oblong hole 256 during the upward movement of each bar 6. This catch 250 and the other catches 208, 208' and 209 also disengage progressively from the recesses 211 respectively designed to hold them in abutment, and the door 200 is finally in the unlocked position.

In order to open the door 200, a thrust force is first of all exerted on the handle 230*b* of the leaf 204*b* (or a traction force on the other handle 236*b* of the same leaf 204*b*), whilst holding the handle 230*b* (or 236*b*) in the raised position. Then the handle 230*a* of the other leaf 204*a* is pushed (or the corresponding handle 236*a* is pulled) in the raised position. This opening sequence is imposed by the overlap of the leaf 204*b* on the leaf 204*a* (see FIG. 6).

As with the first embodiment, it should be noted that a door 200 has the advantage of being able to be controlled in the locked and unlocked positions by means of a force exerted on the control members 110 or 210 which is of reduced intensity, because of the relatively small moment of inertia which characterizes each connecting catch 208, 208' and which facilitates the pivoting thereof.

It will also be noted that a door 1, 200 according to the present invention is not limited to the example embodiments which has just been described, but could have a different number of second catches 9, 9', 209, 209', notably. In addition, the structure and shape of the latter; and those of the connecting catches 8, 8', 208, 208', could be the subject of other variant embodiments.

What is claimed is:

1. A pivoting watertight door having at least one door leaf, two bars having generally straight sections with opposite ends which diverge angularly from said straight sections, a plurality of mounting links pivotally coupled to said leaf for mounting and pivotally supporting said two bars in a spaced parallel relationship, each of said mounting links having a catch, one of said bars having locking means coupled thereto for unlocking and locking said door in a closed position by inserting said catches into keepers in a door jam and two connecting toggle links, said two bars having said opposite angled ends connected together by said two connecting toggle links, two ends of said toggle links being connected to confronting angular ends of individually associated ones of said two bars, and a central part of each of said connecting toggle links being pivotally connected to said leaf.

2. The door of claim 1 and an elastomer sealing strip between said leaf and a door jam in order to make a watertight seal when said door is closed and locked.

3. The door of claim 1 wherein there are at least two of said mounting links coupled to opposite ends of each of said bars and said keepers are in a door jam at locations confronting said mounting said catch on said link.

4. The door of claim 3 and a third of said mounting links coupled to each of said bars at a point between said opposite ends thereof.

5. The door of claim 1 where the locking means for unlocking and locking said door comprises a handle pivotally fixed to said leaf and articulated on said bar to move said bar in opposite directions, said movement of said bar inserting and removing said catches into and out of said keepers.

6. The door of any one of the claims 1–5 wherein said door has two of said leaves which are hinged on opposite sides of a door jam and meet in the middle of said jam, and each of said leaves has an individually associated one of said locking means.

7. The door of any one of the claims 1–5 wherein said door has two of said leaves which hinged on opposite sides of a door jam and meet in the middle of said jam, one of said leaves overlapping and trapping the other of said leaves in the middle of the jam, and said one of said leaves has said locking means associated therewith.

* * * * *